US009171512B2

(12) United States Patent
Ijima

(10) Patent No.: US 9,171,512 B2
(45) Date of Patent: Oct. 27, 2015

(54) DISPLAY

(71) Applicant: MITSUBISHI ELECTRIC CORPORATION, Tokyo (JP)

(72) Inventor: Yukio Ijima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/046,734

(22) Filed: Oct. 4, 2013

(65) Prior Publication Data

US 2014/0118316 A1 May 1, 2014

(30) Foreign Application Priority Data

Oct. 26, 2012 (JP) ..... 2012-236472

(51) Int. Cl.
*G09G 5/00* (2006.01)
*G09G 3/36* (2006.01)
*G09G 3/20* (2006.01)

(52) U.S. Cl.
CPC ..... *G09G 3/3611* (2013.01); *G09G 3/2096* (2013.01); *G09G 2330/08* (2013.01); *G09G 2330/12* (2013.01)

(58) Field of Classification Search
CPC ..... G09G 3/36; G09G 5/00
USPC ..... 345/213, 204, 99, 691, 211, 98, 87, 531
See application file for complete search history.

(56) References Cited

U.S. PATENT DOCUMENTS

2009/0153541 A1* 6/2009 Yusa ..... 345/213
2012/0127145 A1* 5/2012 Jang et al. ..... 345/211
2012/0162291 A1* 6/2012 Kim et al. ..... 345/691
2014/0347348 A1* 11/2014 Ijima ..... 345/213

FOREIGN PATENT DOCUMENTS

| | | | |
|---|---|---|---|
| CN | 101055703 | A | 10/2007 |
| CN | 102479480 | A | 5/2012 |
| JP | 2003-323152 | A | 11/2003 |
| JP | 2008-292926 | A | 12/2008 |
| JP | 2010-190932 | A | 9/2010 |

OTHER PUBLICATIONS

The First Office Action issued by the Chinese Patent Office on Jul. 21, 2015, which corresponds to Chinese Patent Application No. 201310411117.4 and is related to U.S. Appl. No. 14/046,734; with English language partial translation.

* cited by examiner

*Primary Examiner* — Olga Merkoulova
(74) *Attorney, Agent, or Firm* — Studebaker & Brackett PC

(57) ABSTRACT

Image signal line driving circuits each include a timing controller that generates a control signal to control the image signal line driving circuit itself and a different image signal line driving circuit. A master belonging to the image signal line driving circuits has a function of applying the control signal to a slave belonging to the image signal line driving circuits. The image signal line driving circuits each include an abnormality detecting circuit that detects an operation abnormality in the image signal line driving circuit itself, and a master/slave switching circuit that sets the image signal line driving circuit itself as the master or slave image signal line driving circuit. When detecting an abnormality, the abnormality detecting circuit outputs a master/slave switching signal, thereby switching the slave image signal line driving circuit to the master and switching the master image signal line driving circuit to the slave.

9 Claims, 10 Drawing Sheets

DISPLAY

FIELD OF THE INVENTION

The present invention relates to a display such as a liquid crystal display and more specifically, to an active matrix display.

BACKGROUND ART

Nowadays, displays such as liquid crystal displays are used in a wide range of areas including televisions for domestic purposes and displays for industrial purposes.

Referring for example to a liquid crystal display, the structure thereof is roughly divided into a liquid crystal panel, and a driving device that drives the liquid crystal panel. Conventionally, the driving device includes a plurality of image signal line driving circuits, a plurality of scanning line driving circuits, and a timing controller functioning as a control circuit that drives these driving circuits.

Each image signal line driving circuit is an integrated circuit to drive an image signal line of the liquid crystal panel. A plurality of such integrated circuits is used to drive all image signal lines of the liquid crystal panel. Likewise, each scanning line driving circuit is an integrated circuit to drive a scanning line of the liquid crystal panel. A plurality of such integrated circuits is used to drive all scanning lines of the liquid crystal panel.

The timing controller receives image data, a control reference signal according to which the image signal line driving circuits and the scanning line driving circuits are controlled, and a dot clock (DCLK) according to which process is performed. The control reference signal includes a horizontal synchronization signal (HD) functioning as a reference signal for horizontal synchronization of the liquid crystal panel, a vertical synchronization signal (VD) functioning as a reference signal for vertical synchronization of the liquid crystal panel, a data enable signal (DENA) indicating a period where image data is valid, and the like.

An image signal line driving circuit having a (built-in) timing controller has been developed recently, as disclosed in Japanese Patent Application Laid-Open No. 2010-190932. This image signal line driving circuit does not require a circuit board for a timing controller, making it possible to reduce cost for structural components. As a result, a liquid crystal display can be provided at lower cost.

A liquid crystal display includes a plurality of image signal line driving circuits having built-in timing controllers. Meanwhile, only one timing controller is required in the liquid crystal display. Thus, one of the image signal line driving circuits is used in a master mode, whereas the other image signal line driving circuit is used in a slave mode. More specifically, the image signal line driving circuit in the master mode operates based on the timing controller of the image signal line driving circuit itself, whereas the image signal line driving circuit in the slave mode operates in response to a control signal applied from the timing controller of the image signal line driving circuit in the master mode. In this case, power consumption is reduced by stopping the timing controller of the image signal line driving circuit in the slave mode.

The image signal line driving circuit having the built-in timing controller is intended for consumer use such as tablet terminals and notebook-size PCs with the intention of cost reduction, and is expected to be used in a wider range of applications such as vehicle installation.

Meanwhile, the timing controller in the image signal line driving circuit in the slave mode stops its function or performs only part of its operation as described above, meaning that the timing controller does not function effectively.

SUMMARY OF THE INVENTION

It is an object of the present invention to provide a display where an image signal line driving circuit in a slave mode can offer backup when an abnormality is generated in an image signal line driving circuit in a master mode.

According to an aspect of the display of the present invention, the display includes: a display panel in which a plurality of image signal lines and a plurality of scanning lines are formed in a matrix; a plurality of image signal line driving circuits arranged around the display panel, the image signal line driving circuits driving the image signal lines; and a scanning line driving circuit arranged around the display panel, the scanning line driving circuit driving the scanning lines. Each of the image signal line driving circuits includes a timing controller that generates a control signal to control the image signal line driving circuit itself and a different image signal line driving circuit. An image signal line driving circuit in a master mode among the plurality of image signal line driving circuits has a function of applying the control signal to an image signal line driving circuit in a slave mode among the plurality of image signal line driving circuits. Each of the image signal line driving circuits includes an abnormality detecting circuit and a master/slave switching circuit. The abnormality detecting circuit detects an operation abnormality in the image signal line driving circuit itself. The master/slave switching circuit sets the image signal line driving circuit itself as the image signal line driving circuit in the master mode or as the image signal line driving circuit in the slave mode. When detecting an abnormality, the abnormality detecting circuit outputs a master/slave switching signal and applies the master/slave switching signal to the master/slave switching circuit in the image signal line driving circuit in the master mode and the master/slave switching circuit in the image signal line driving circuit in the slave mode, thereby switching the image signal line driving circuit in the slave mode to the master mode and switching the image signal line driving circuit in the master mode to the slave mode.

In the aforementioned display, an abnormality in an image signal line driving circuit is detected, and the image signal line driving circuit in the slave mode is automatically switched to the master mode. This allows backup operation by the slave in response to generation of an abnormality in the master.

These and other objects, features, aspects and advantages of the present invention will become more apparent from the following detailed description of the present invention when taken in conjunction with the accompanying drawings.

EMBODIMENT FOR CARRYING OUT THE INVENTION

First Preferred Embodiment

Figure 1:
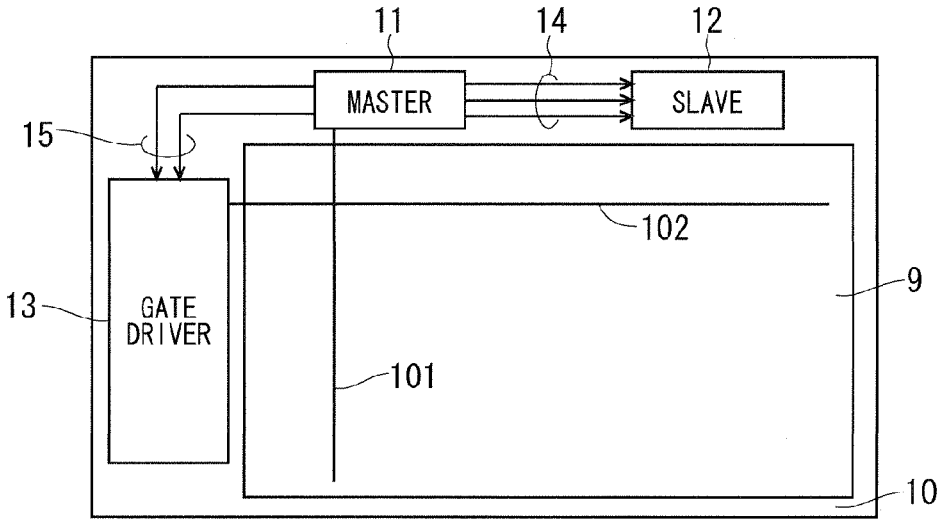
FIG. 1 is a block diagram schematically showing the structure of a liquid crystal display.

FIG. 1 is a block diagram schematically showing the structure of a liquid crystal display 10, and peripheral circuits to drive a liquid crystal panel 9 in which image signal lines 101 and scanning lines 102 are formed in a matrix. The liquid crystal display 10 is an active matrix display including active elements such as thin-film transistors (TFTs) formed at intersections between the image signal lines 101 and the scanning lines 102. The structure of the liquid crystal display 10 is conventional so that it is not described here. In the description below, the present invention is described as being directed to a liquid crystal display. However, the present invention is not limited to a liquid crystal display but is applicable to any active matrix display. As an example, the present invention is applicable to a plasma display and an organic EL display.

An image signal line driving circuit 11 and an image signal line driving circuit 12 to drive the image signal lines 101, and a scanning line driving circuit 13 (hereinafter called a "gate driver") to drive the scanning lines 102, are arranged around the liquid crystal panel 9. For the sake of convenience, two image signal line driving circuits and only one scanning line driving circuit are shown in FIG. 1. However, a large number of image signal line driving circuits and a large number of scanning line driving circuits are actually provided.

The image signal line driving circuits 11 and 12 each have a built-in timing controller. In this example, the image signal line driving circuit 11 is called an image signal line driving circuit in a master mode (called a "master"), whereas the image signal line driving circuit 12 is called an image signal line driving circuit in a slave mode (called a "slave").

The image signal line driving circuit 11 receives a dot clock (DCLK) according to which process is performed from outside, and a control reference signal including: a horizontal synchronization signal (HD) functioning as a reference signal for horizontal synchronization of the liquid crystal panel; a vertical synchronization signal (VD) functioning as a reference signal for vertical synchronization of the liquid crystal panel; a data enable signal (DENA) indicating a period where image data is valid, and the like. Based on these signals, the image signal line driving circuit 11 generates a control signal to control the image signal line driving circuit 12, and applies the control signal via an interconnection part 14 to the image signal line driving circuit 12. The image signal line driving circuit 11 also generates a control signal to control the scanning line driving circuit 13, and applies the control signal via an interconnection part 15 to the scanning line driving circuit 13.

Figure 2:
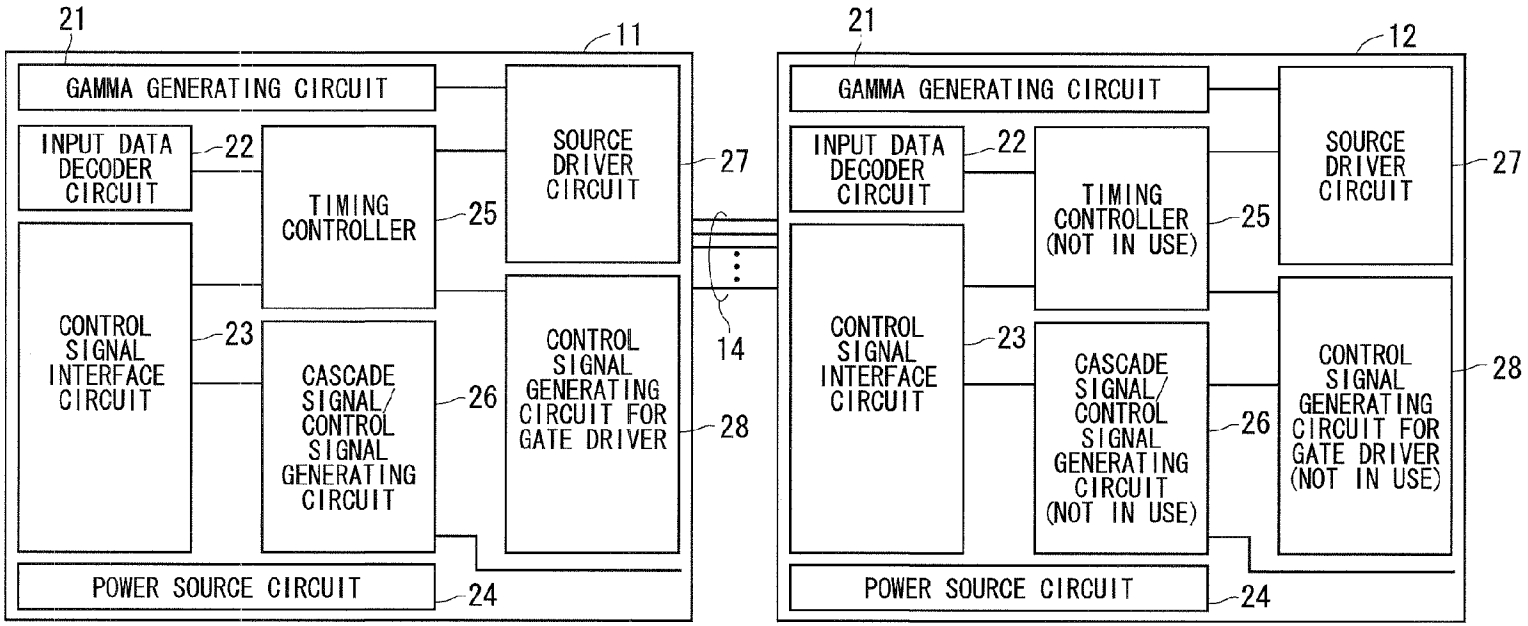
FIG. 2 is a block diagram showing the internal structures of image signal line driving circuits.

FIG. 2 is a block diagram showing the internal structures of the image signal line driving circuits 11 and 12. The image signal line driving circuits 11 and 12 include the same components, and these components are identified by the same reference numbers.

As shown in FIG. 2, the image signal line driving circuits 11 and 12 each include a gamma generating circuit 21, an input data decoder circuit 22, a control signal interface circuit 23, a power source circuit 24, a timing controller 25, a cascade signal/control signal generating circuit 26, a source driver circuit 27, and a control signal generating circuit 28 for gate driver.

The timing controller 25 is connected to the input data decoder circuit 22 and the control signal interface circuit 23. The timing controller 25 is a circuit that receives image data, a control reference signal according to which an image signal line driving circuit and a scanning line driving circuit are controlled, and a dot clock according to which process is performed, and generates a control signal to be applied to the source driver circuit 27 and the control signal generating circuit 28 for gate driver.

The gamma generating circuit 21 is a circuit that performs gamma correction on image data. The input data decoder circuit 22 is a circuit that decodes input data. The control signal interface circuit 23 is an interface circuit for a control signal.

The cascade signal/control signal generating circuit 26 is a circuit that generates a cascade signal to control a plurality of shift registers connected in cascade of the scanning line driving circuit 13. The cascade signal is applied to the scanning line driving circuit 13.

The source driver circuit 27 is a circuit that drives an image signal line. The control signal generating circuit 28 for gate driver is a circuit that generates a gate control signal to be applied to the scanning line driving circuit 13.

In FIG. 2, the image signal line driving circuits 11 and 12 are connected via the interconnection part 14, and the image signal line driving circuit 12 operates as the slave. Thus, the timing controller 25, the cascade signal/control signal generating circuit 26, and the control signal generating circuit 28 for gate driver in the image signal line driving circuit 12 are in condition of non-use.

Figure 3:
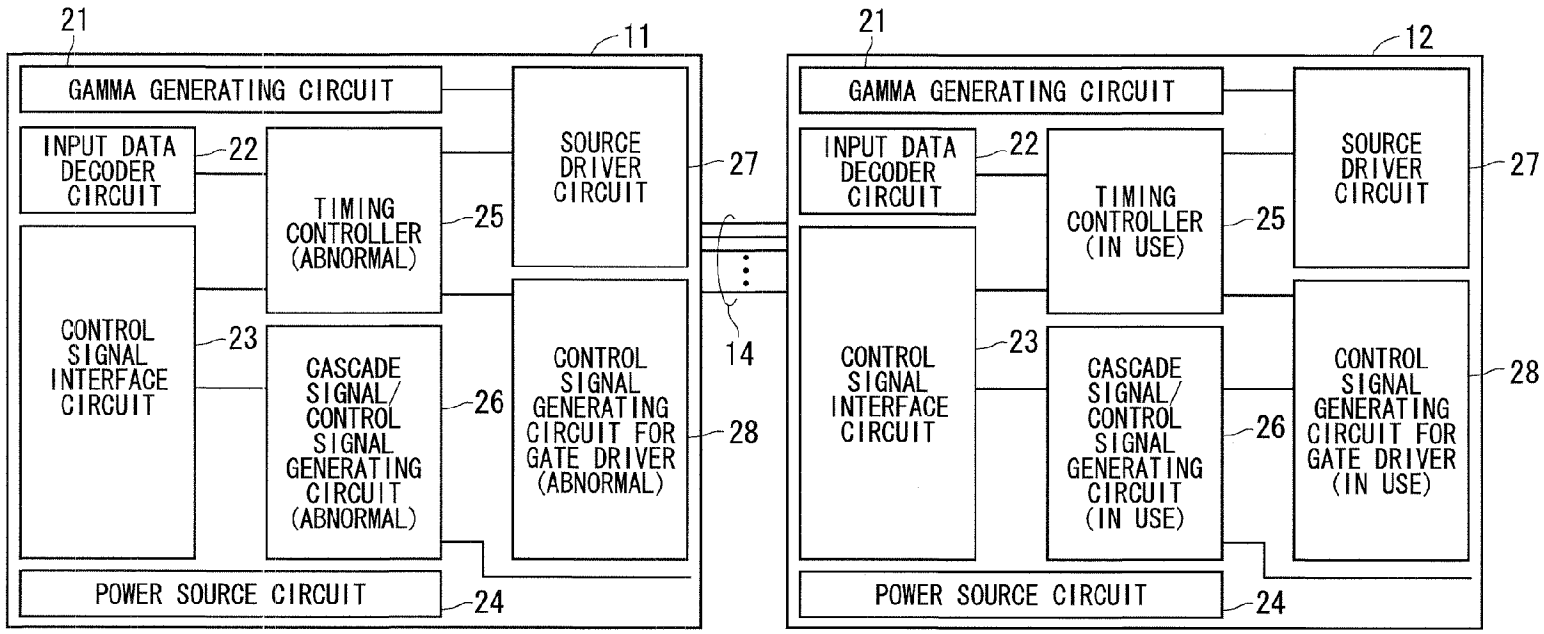
FIG. 3 explains how a slave image signal line driving circuit offers backup when an abnormality is generated in a master image signal line driving circuit.

If an abnormality is generated in any of the timing controller 25, the cascade signal/control signal generating circuit 26, and the control signal generating circuit 28 for gate driver in the image signal line driving circuit 11 as shown in FIG. 3, the timing controller 25, the cascade signal/control signal generating circuit 26, and the control signal generating circuit 28 for gate driver in the slave image signal line driving circuit 12 are brought into condition of use and the image signal line driving circuit 12 is put into the master mode.

A structure to realize the aforementioned backup by an image signal line driving circuit in the slave mode is described below.

Figure 4:
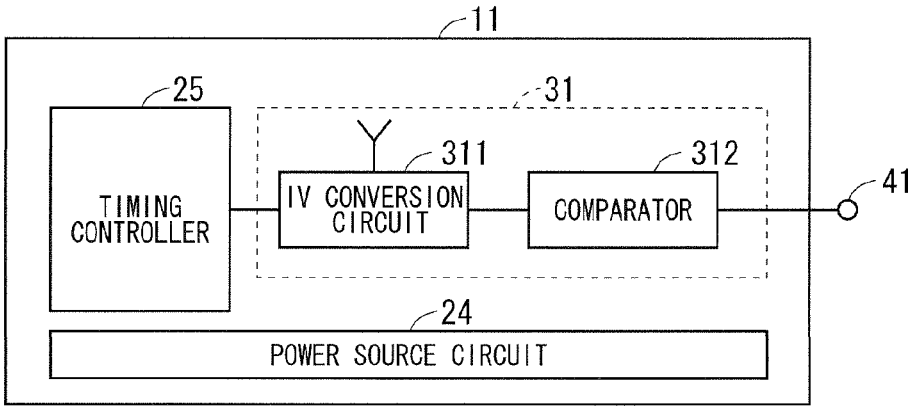
FIG. 4 shows the structure of an abnormality detecting circuit forming part of the image signal line driving circuit of the liquid crystal display of the first preferred embodiment of the present invention.

FIG. 4 shows the structure of an abnormality detecting circuit 31 forming part of the image signal line driving circuit 11 and which detects an abnormality in a consumption current. The abnormality detecting circuit 31 is connected to a power source input part of the timing controller 25, and includes an IV conversion circuit 311 that converts a consumption current in the timing controller 25 to a voltage by current-voltage conversion (IV conversion), and a comparator 312.

An output voltage of the IV conversion circuit 311 is applied to the comparator 312, and the comparator 312 compares the output voltage to a predetermined reference voltage. If the output voltage of the IV conversion circuit 311 is higher than the reference voltage, the abnormality detecting circuit 31 determines that the consumption current in the timing controller 25 has increased and outputs a master/slave switching signal 41. The abnormality detecting circuit 31 is described as one that detects an abnormality if the consumption current in the timing controller 25 has increased. The abnormality detecting circuit 31 may also detect an abnormality if the consumption current becomes lower than a prescribed value.

An abnormality to be detected by the abnormality detecting circuit 31 is not limited to that generated in the timing controller 25, but the abnormality detecting circuit 31 may also detect an abnormality generated in the cascade signal/control signal generating circuit 26 or the control signal generating circuit 28 for gate driver.

Figure 5:
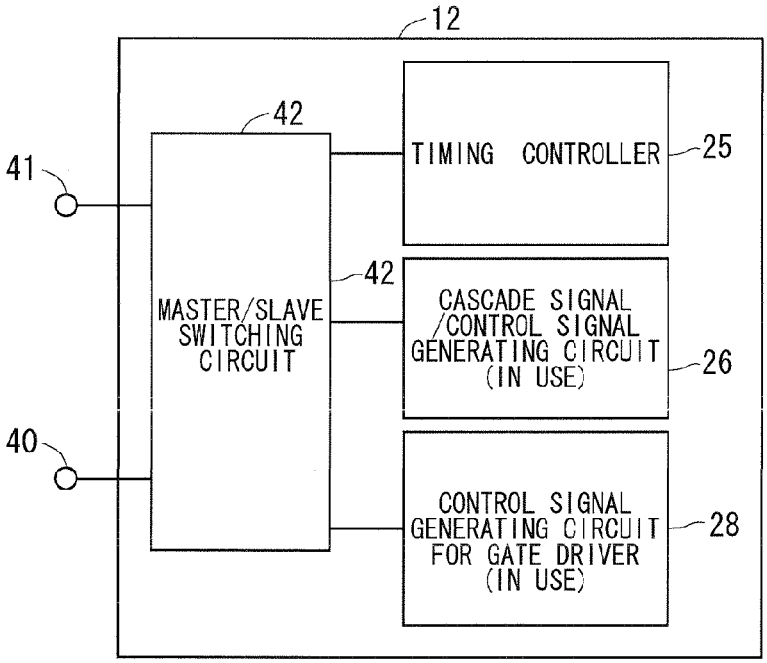
FIG. 5 is a block diagram showing the structure of a master/slave switching circuit.

FIG. 5 is a block diagram showing the structure of a master/slave switching circuit 42 forming part of the image signal line driving circuit 12. The master/slave switching circuit 42 is a circuit that switches the image signal line driving circuit 12 to the slave mode or the master mode in response to a master/slave switching signal 40 and a master/slave switching signal 41. The master/slave switching circuit 42 applies the switching signals to the timing controller 25, the cascade signal/control signal generating circuit 26, and the control signal generating circuit 28 for gate driver. These circuits (circuits forming a timing controller unit) having received the switching signals stop their operations and are put into the slave mode if they have been in operating condition (master mode), whereas they start their operations and are put into the master mode if they have been in halt condition (slave mode).

The image signal line driving circuit 11 includes the same master/slave switching circuit 42. The image signal line driving circuit 11 is switched from the master mode to the slave mode in response to the master/slave switching signal 41.

The master/slave switching signal 40 is a signal to determine if the image signal line driving circuit 12 is to operate as the master or as the slave. If the image signal line driving circuit 11 is to operate as the master, the master/slave switching signal 40 is applied so as to make the image signal line driving circuit 12 operate as the slave.

The master/slave switching signal 41 is a signal applied from the image signal line driving circuit 11 if an abnormality is generated in the image signal line driving circuit 11. The master/slave switching signal 41 switches the image signal line driving circuit 12 to the master mode, and operates the timing controller 25, the cascade signal/control signal generating circuit 26, and the control signal generating circuit 28 for gate driver in the image signal line driving circuit 12.

Figure 6:
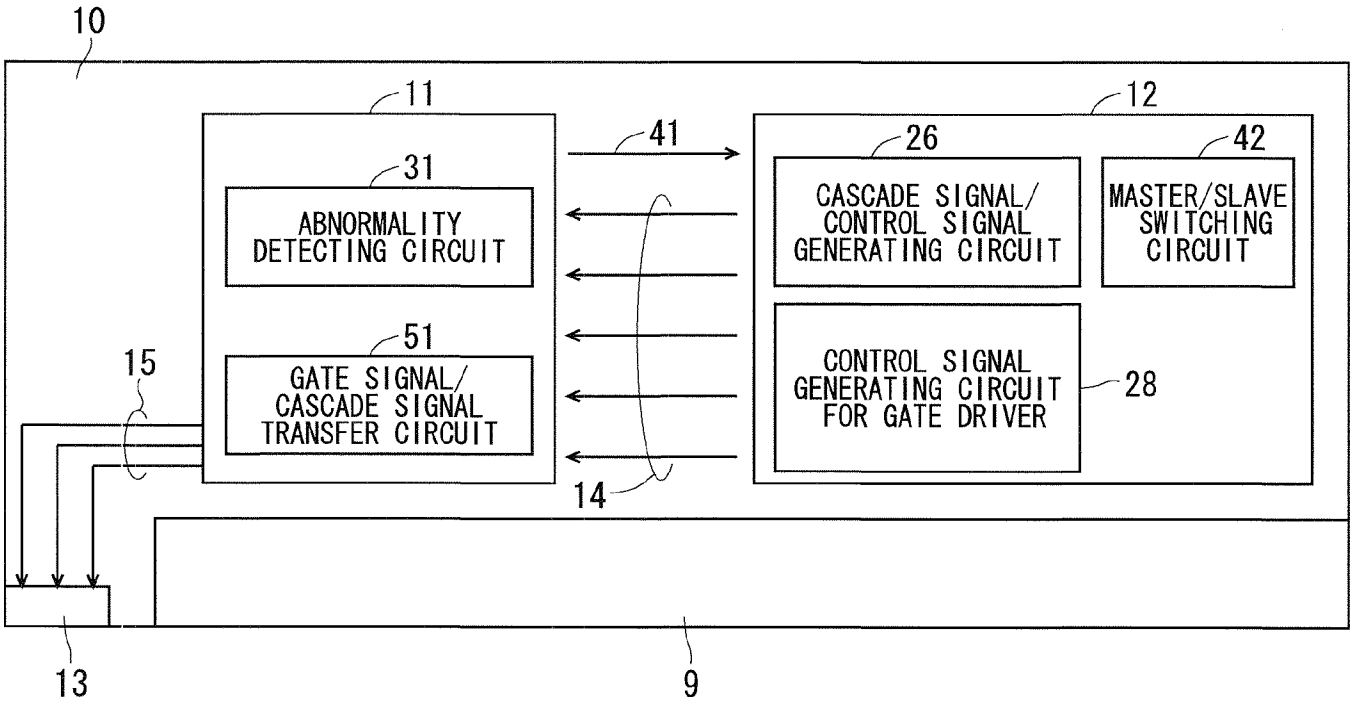
FIG. 6 shows the structures of the image signal line driving circuits and signal flows in the liquid crystal display of the first preferred embodiment of the present invention.

FIG. 6 shows the structures of the image signal line driving circuits 11 and 12 and signal flows in the liquid crystal display 10 of the first preferred embodiment. As shown in FIG. 6, a cascade signal generated by the cascade signal/control signal generating circuit 26 and a gate control signal generated by the control signal generating circuit 28 for gate driver in the image signal line driving circuit 12 operating as the master are applied to the image signal line driving circuit 11, and are transferred to the scanning line driving circuit 13 via a gate signal/cascade signal transfer circuit 51 in the image signal line driving circuit 11.

Even if an image signal line driving circuit having operated as the slave is switched to the master, the aforementioned structure allows application of the cascade signal and the gate control signal to the scanning line driving circuit 13.

As described above, in the liquid crystal display of the first preferred embodiment, an abnormality in an image signal line driving circuit in the master mode is detected based on a consumption current, an image signal line driving circuit in the slave mode is automatically switched to the master mode, and the image signal line driving circuit switched to the master mode generates the cascade signal and the gate control signal. This allows backup (fail-safe) operation by the slave in response to generation of an abnormality in the master.

Second Preferred Embodiment

Figure 7:
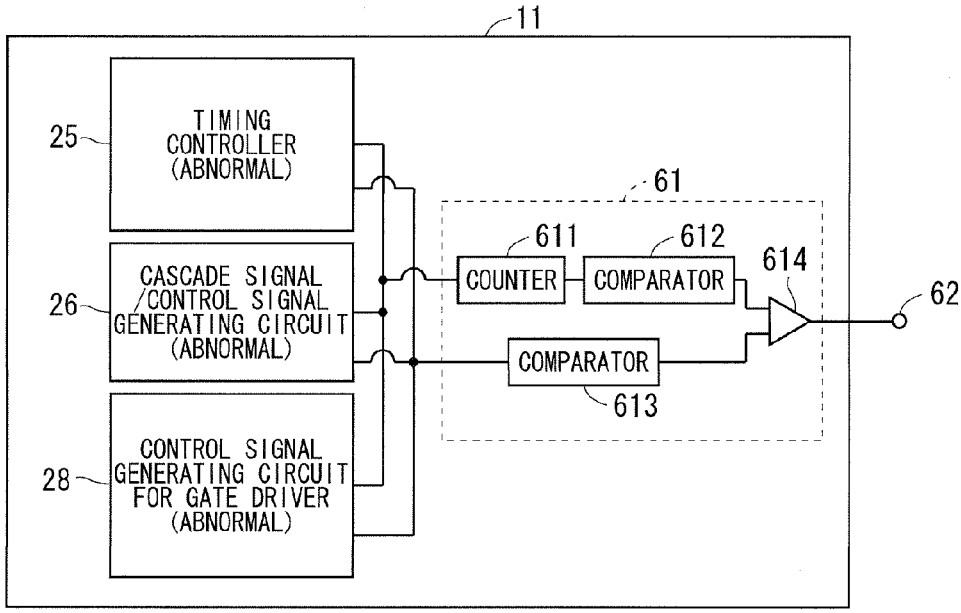
FIG. 7 shows the structure of an abnormality detecting circuit forming part of an image signal line driving circuit of a liquid crystal display of a second preferred embodiment of the present invention.

FIG. 7 shows the structure of an abnormality detecting circuit 61 forming part of an image signal line driving circuit 11 in a liquid crystal display of a second preferred embodiment of the present invention. The abnormality detecting circuit 61 is a circuit that detects an abnormality of the cycles, the voltage levels or the like of control signals (generated by a timing controller 25, a cascade signal/control signal generating circuit 26, and a control signal generating circuit 28 for gate driver). The abnormality detecting circuit 61 includes a counter 611 that detects the cycles of the control signals output from the timing controller 25, the cascade signal/control signal generating circuit 26 and the control signal generating circuit 28 for gate driver, and a comparator 612 connected to the counter 611. The abnormality detecting circuit 61 further includes a comparator 613 that detects the voltage levels of the control signals output from the timing controller 25, the cascade signal/control signal generating circuit 26 and the control signal generating circuit 28 for gate driver, and an amplifier 614 that amplifies the outputs of the comparators 612 and 613 and outputs the results.

The cycle of a control signal detected by the counter 611 is compared to a predetermined signal cycle by the comparator 612. If the signal cycle detected by the counter 611 is shorter or longer than the prescribed value, the abnormality detecting circuit 61 determines that an abnormality is generated in the control signal, and outputs a master/slave switching signal 62 from the amplifier 614.

The voltage levels of the control signals output from the timing controller 25, the cascade signal/control signal generating circuit 26, and the control signal generating circuit 28 for gate driver are compared to a predetermined voltage level by the comparator 613. If the voltage levels of the control signals are higher or lower than the prescribed value, the abnormality detecting circuit 61 determines that an abnormality is generated in the control signals, and outputs the master/slave switching signal 62 from the amplifier 614.

An image signal line driving circuit 12 includes the master/slave switching circuit 42 shown in FIG. 5, and receives the master/slave switching signal 62 instead of the master/slave switching signal 41. The master/slave switching circuit 42 having received the master/slave switching signal 62 performs the same operation as that of the first preferred embodiment. As a result, a cascade signal generated by a cascade signal/control signal generating circuit 26 and a gate control signal generated by a control signal generating circuit 28 for gate driver in the image signal line driving circuit 12 operating as the master are applied to the image signal line driving circuit 11, and are transferred to a scanning line driving circuit 13 via a gate signal/cascade signal transfer circuit 51 (FIG. 6) in the image signal line driving circuit 11.

As described above, in the liquid crystal display of the second preferred embodiment, an abnormality in an image signal line driving circuit in the master mode is detected based on a control signal, an image signal line driving circuit in the slave mode is automatically switched to the master mode, and the image signal line driving circuit switched to the master mode generates the cascade signal and the gate control signal. This allows backup (fail-safe) operation by the slave in response to generation of an abnormality in the master.

Third Preferred Embodiment

Figure 8:
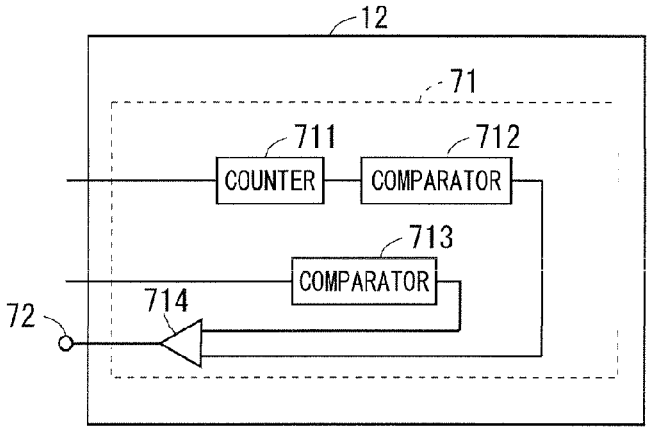
FIG. 8 shows the structure of an abnormality detecting circuit forming part of an image signal line driving circuit of a liquid crystal display of a third preferred embodiment of the present invention.

FIG. 8 shows the structure of an abnormality detecting circuit 71 forming part of an image signal line driving circuit 12 in a liquid crystal display of a third preferred embodiment of the present invention. The abnormality detecting circuit 71 is a circuit that detects an abnormality of the cycles, voltage levels or the like of control signals applied from an image signal line driving circuit 11 operating as the master (generated by a timing controller 25, a cascade signal/control signal generating circuit 26, and a control signal generating circuit 28 for gate driver). The abnormality detecting circuit 61 includes a counter 711 that detects the cycles of the control signals applied from the image signal line driving circuit 11, and a comparator 712 connected to the counter 711. The abnormality detecting circuit 71 further includes a comparator 713 that detects the voltage levels of the control signals applied from the image signal line driving circuit 11, and an amplifier 714 that amplifies the outputs of the comparators 712 and 713 and outputs the results.

The cycle of a control signal detected by the counter 711 is compared to a predetermined signal cycle by the comparator 712. If the signal cycle detected by the counter 711 is shorter or longer than the prescribed value, the abnormality detecting circuit 71 determines that an abnormality is generated in the control signal, and outputs a master/slave switching signal 72 from the amplifier 714.

The voltage level of the control signal applied from the image signal line driving circuit 11 is compared to a predetermined voltage level by the comparator 713. If the voltage level of the control signal is higher or lower than the prescribed value, the abnormality detecting circuit 71 determines that an abnormality is generated in the control signal, and outputs the master/slave switching signal 72 from the amplifier 714.

If the image signal line driving circuit 12 detects an abnormality of the cycle, voltage level or the like of the control signal applied from the image signal line driving circuit 11, the image signal line driving circuit 12 itself starts to operate as the master based on the master/slave switching signal 72 output from the amplifier 714, and applies the master/slave switching signal 72 to the image signal line driving circuit 11.

The image signal line driving circuit 12 includes the master/slave switching circuit 42 shown in FIG. 5, and receives the master/slave switching signal 72 instead of the master/slave switching signal 41. The master/slave switching circuit 42 having received the master/slave switching signal 72 performs the same operation as that of the first preferred embodiment. As a result, a cascade signal generated by a cascade signal/control signal generating circuit 26 and a gate control signal generated by a control signal generating circuit 28 for gate driver in the image signal line driving circuit 12 operating as the master are applied to the image signal line driving circuit 11, and are transferred to a scanning line driving circuit 13 via a gate signal/cascade signal transfer circuit 51 (FIG. 6) in the image signal line driving circuit 11.

The master/slave switching circuit 42 shown in FIG. 5 is also provided in the image signal line driving circuit 11. The image signal line driving circuit 11 receives the master/slave switching signal 72 instead of the master/slave switching signal 41. If the master/slave switching signal 72 is applied from the image signal line driving circuit 12 to the image signal line driving circuit 11, the image signal line driving circuit 11 is switched from the master mode to the slave mode.

Figure 9:
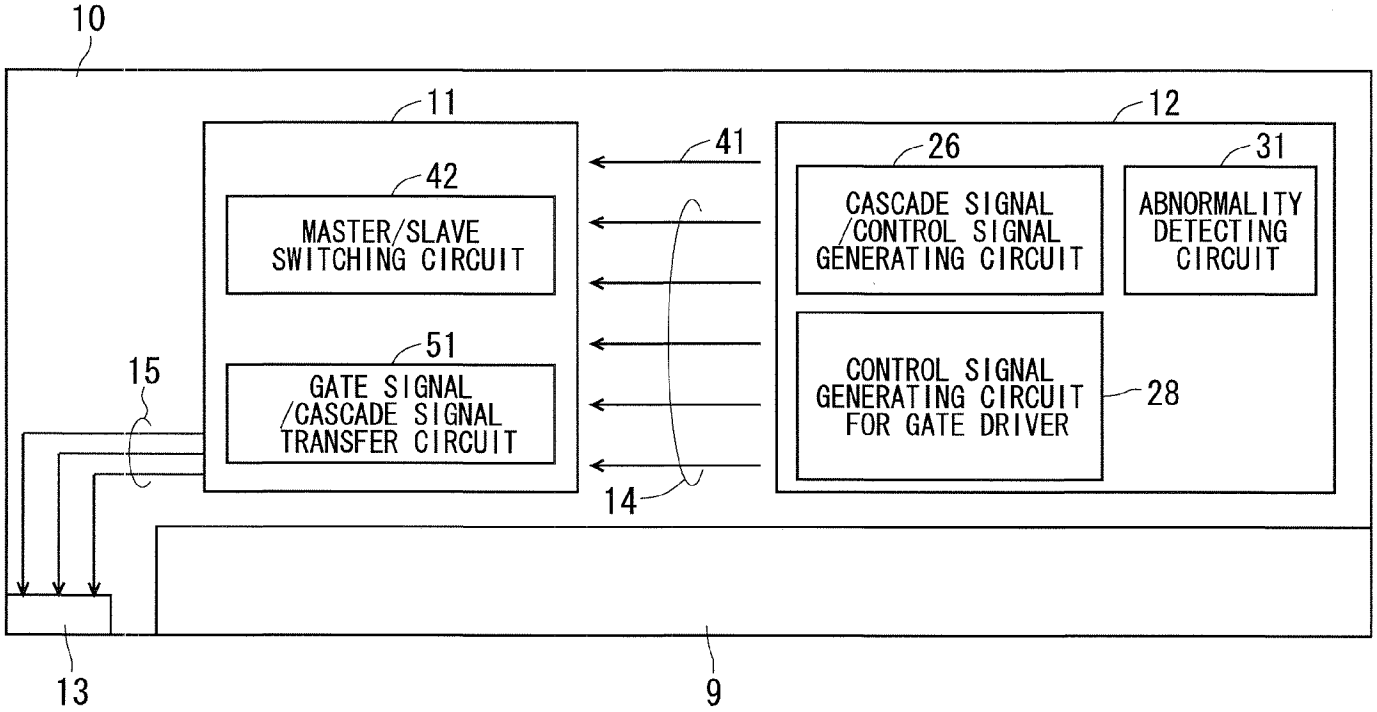
FIG. 9 shows the structures of image signal line driving circuits and signal flows in the liquid crystal display of the third preferred embodiment of the present invention.

FIG. 9 shows the structures of the image signal line driving circuits 11 and 12 and signal flows in the liquid crystal display 10 of the third preferred embodiment. As shown in FIG. 9, the cascade signal generated by the cascade signal/control signal generating circuit 26 and the gate control signal generated by the control signal generating circuit 28 for gate driver in the image signal line driving circuit 12 operating as the master are applied to the image signal line driving circuit 11, and are transferred to the scanning line driving circuit 13 via the gate signal/cascade signal transfer circuit 51 in the image signal line driving circuit 11.

As described above, in the liquid crystal display of the third preferred embodiment, the image signal line driving circuit 12 detects an abnormality of a control signal applied from the image signal line driving circuit 11 operating as the master, the image signal line driving circuit in the slave mode is automatically switched to the master mode, and the image signal line driving circuit switched to the master mode generates the cascade signal and the gate control signal. This allows backup (fail-safe) operation by the slave in response to generation of an abnormality in the master.

An abnormality is detected not in the image signal line driving circuit 11 where the abnormality is generated, but is detected in the image signal line driving circuit 12. Thus, the abnormality can be detected more precisely.

Fourth Preferred Embodiment

Figure 10:
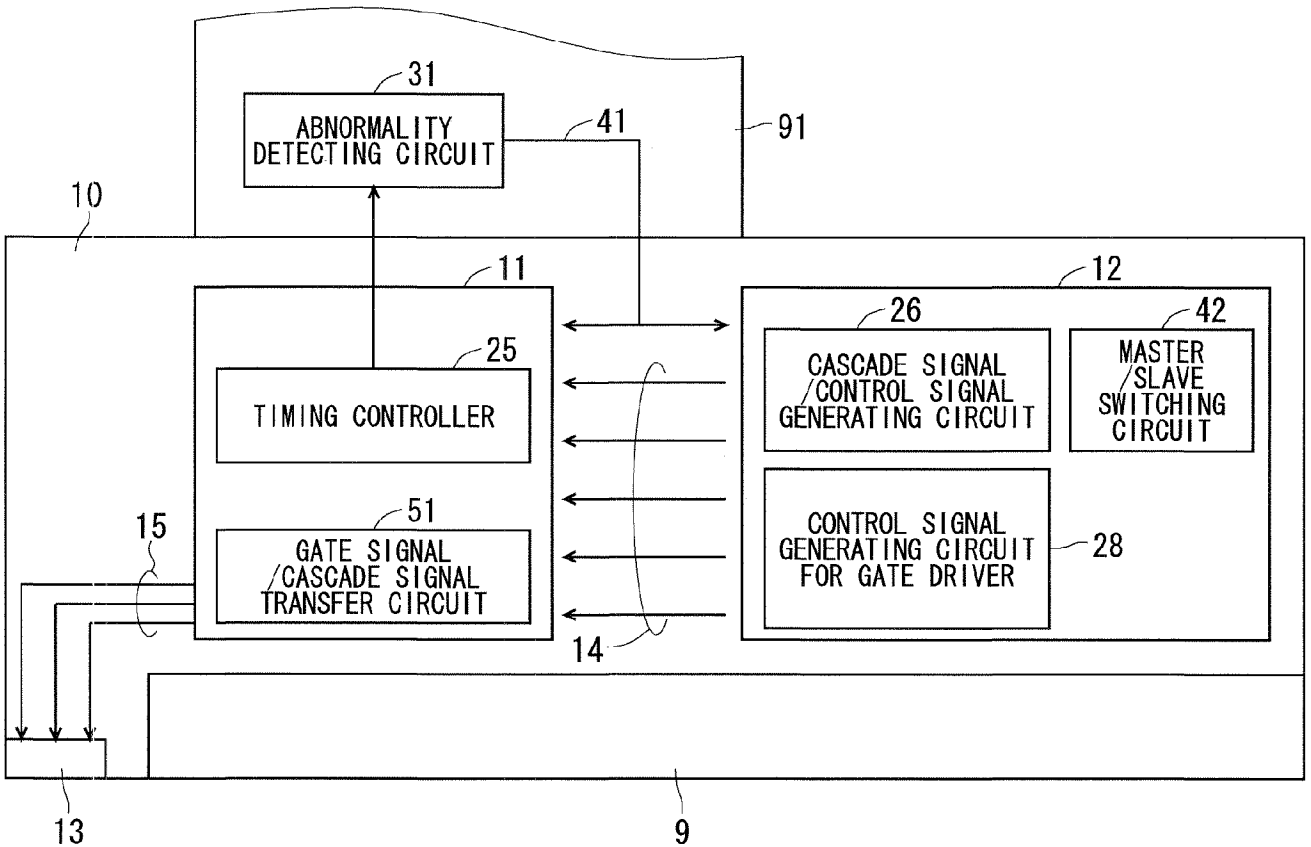
FIG. 10 shows the structures of image signal line driving circuits, an abnormality detecting circuit formed on a connection substrate, and signal flows in a liquid crystal display of a fourth preferred embodiment of the present invention.

FIG. 10 shows the structures of an image signal line driving circuit 11 and an image signal line driving circuit 12, an abnormality detecting circuit 31 formed on a connection substrate 91 such as an FPC (flexible printed circuit), and signal flows in a liquid crystal display 10 of a fourth preferred embodiment. As shown in FIG. 10, the abnormality detecting circuit 31 formed on the connection substrate 91 is a circuit that outputs a master/slave switching signal 41 if detecting an abnormality in a timing controller 25 of the image signal line driving circuit 11 operating as the master, and the structure thereof is the same as that of the abnormality detecting circuit 31 described by referring to FIG. 4.

The image signal line driving circuit 12 includes a master/slave switching circuit 42. In response to the master/slave switching signal 41 output from the abnormality detecting circuit 31 having detected an abnormality in the image signal line driving circuit 11, the master/slave switching circuit 42 switches the image signal line driving circuit 12 to the master mode, and operates a timing controller 25, a cascade signal/control signal generating circuit 26, and a control signal generating circuit 28 for gate driver in the image signal line driving circuit 12. The master/slave switching signal 41 is also applied to a master/slave switching circuit 42 in the image signal line driving circuit 11 (not shown in FIG. 10). The image signal line driving circuit 11 is switched from the master mode to the slave mode in response to the master/slave switching signal 41.

Then, a cascade signal generated by the cascade signal/control signal generating circuit 26 and a gate control signal generated by the control signal generating circuit 28 for gate driver in the image signal line driving circuit 12 are applied to the image signal line driving circuit 11, and are transferred to a scanning line driving circuit 13 via a gate signal/cascade signal transfer circuit 51 in the image signal line driving circuit 11.

An abnormality to be detected by the abnormality detecting circuit 31 is not limited to that generated in the timing controller 25, but the abnormality detecting circuit 31 may also detect an abnormality generated in the cascade signal/control signal generating circuit 26 or the control signal generating circuit 28 for gate driver.

The abnormality detecting circuit 31 is not always formed on the connection substrate 91 but it may also be formed on a glass substrate on which the image signal line driving circuits 11 and 12 are mounted.

As described above, in the liquid crystal display of the fourth preferred embodiment, an abnormality is detected not in the image signal line driving circuit 11 where the abnormality is generated, but is detected in the abnormality detecting circuit 31 formed on the connection substrate 91 or the glass substrate. Thus, the abnormality can be detected more precisely.

Fifth Preferred Embodiment

Figure 11:
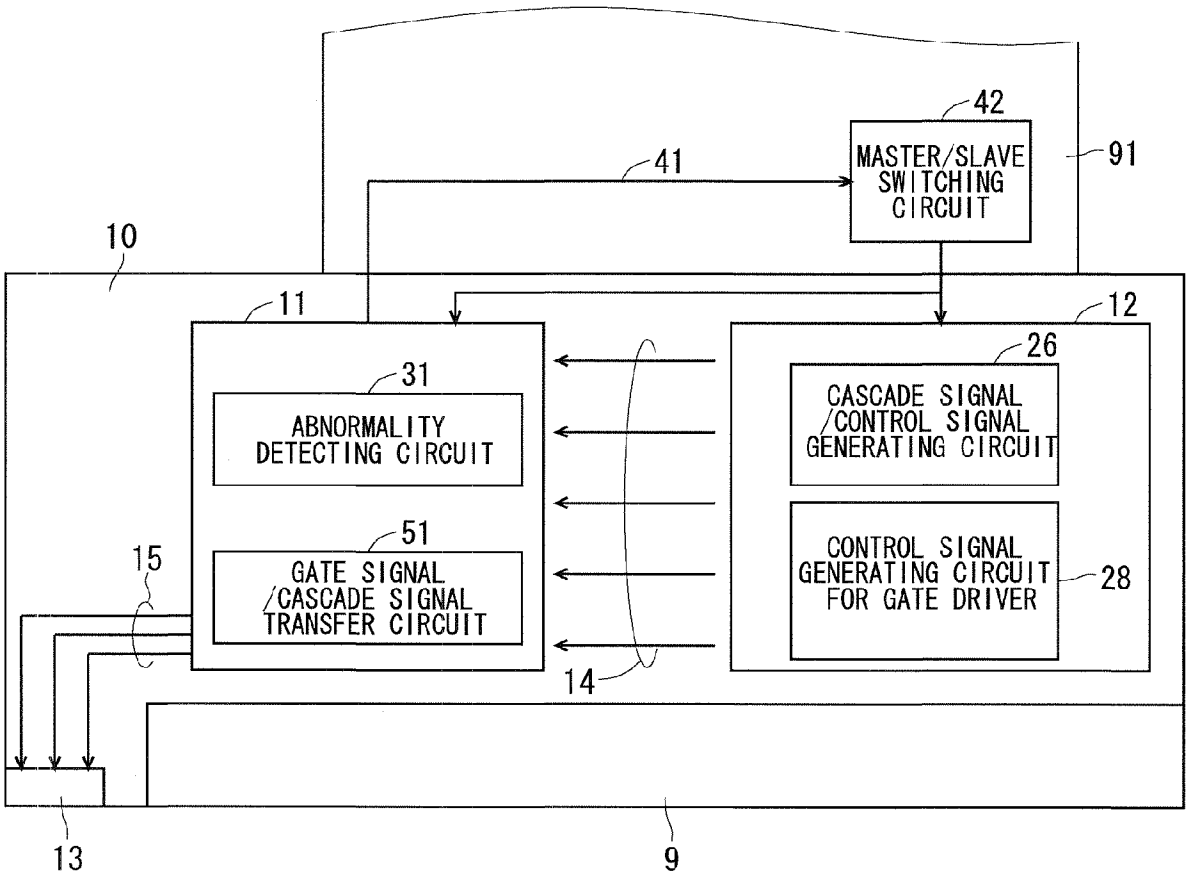
FIG. 11 shows the structures of image signal line driving circuits, a master/slave switching circuit formed on a connection substrate, and signal flows in a liquid crystal display of a fifth preferred embodiment of the present invention.

FIG. 11 shows the structures of an image signal line driving circuit 11 and an image signal line driving circuit 12, a master/slave switching circuit 42 formed on a connection substrate 91 such as an FPC, and signal flows in a liquid crystal display 10 of a fifth preferred embodiment. As shown in FIG. 11, the master/slave switching circuit 42 formed on the connection substrate 91 is a circuit that switches the image signal line driving circuit 12 to the slave mode or the master mode in response to a master/slave switching signal 41 an abnormality detecting circuit 31 in the image signal line driving circuit 11 operating as the master outputs to the master/slave switching circuit 42 when detecting an abnormality generated for example in a timing controller 25. The structure of the master/slave switching circuit 42 is the same as that of the master/slave switching circuit 42 shown in FIG. 5. The master/slave switching signal 41 from the abnormality detecting circuit 31 is also applied to the image signal line driving circuit 11 to switch the image signal line driving circuit 11 from the master mode to the slave mode.

In response to the master/slave switching signal 41 output from the abnormality detecting circuit 31 having detected an abnormality in the image signal line driving circuit 11, the master/slave switching circuit 42 switches the image signal line driving circuit 12 to the master mode, and operates a timing controller 25, a cascade signal/control signal generating circuit 26, and a control signal generating circuit 28 for gate driver in the image signal line driving circuit 12.

Then, a cascade signal generated by the cascade signal/control signal generating circuit 26 and a gate control signal generated by the control signal generating circuit 28 for gate driver in the image signal line driving circuit 12 are applied to the image signal line driving circuit 11, and are transferred to a scanning line driving circuit 13 via a gate signal/cascade signal transfer circuit 51 in the image signal line driving circuit 11.

The master/slave switching circuit 42 is not always formed on the connection substrate 91 but it may also be formed on a glass substrate on which the image signal line driving circuits 11 and 12 are mounted.

As described above, in the liquid crystal display of the fifth preferred embodiment, the master/slave switching circuit 42 is formed in a place different from the image signal line driving circuits 11 and 12, thereby achieving size reduction of the image signal line driving circuits 11 and 12.

Sixth Preferred Embodiment

Figure 12:
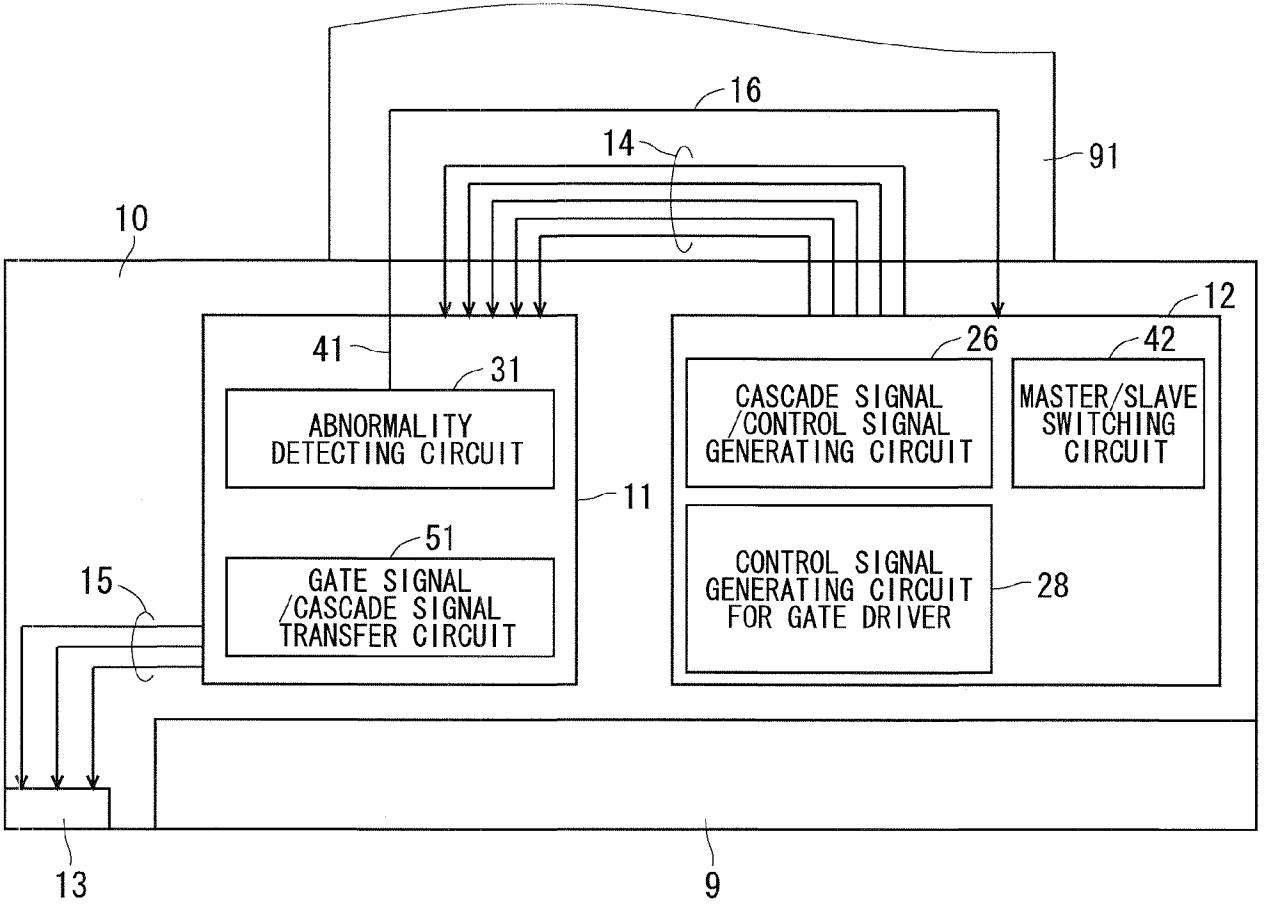
FIG. 12 shows the structures of image signal line driving circuits and signal flows through interconnection parts formed on a connection substrate in a liquid crystal display of a sixth preferred embodiment of the present invention.

FIG. 12 shows the structures of an image signal line driving circuit 11 and an image signal line driving circuit 12, and signal flows through interconnection parts formed on a connection substrate 91 such as an FPC in a liquid crystal display 10 of a sixth preferred embodiment.

As shown in FIG. 12, an interconnection part 16 and an interconnection part 14 are formed on the connection substrate 91. The interconnection part 16 transmits a master/slave switching signal 41 an abnormality detecting circuit 31 in the image signal line driving circuit 11 operating as the master outputs when detecting an abnormality generated for example in a timing controller 25. The interconnection part 14 transmits a control signal such as a cascade signal generated by a cascade signal/control signal generating circuit 26 and a gate control signal generated by a control signal generating circuit 28 for gate driver in the image signal line driving circuit 12 functioning as the master when the image signal line driving circuit 11 operates in an abnormal condition.

As described above, in the liquid crystal display of the sixth preferred embodiment, the interconnection part 16 that transmits the master/slave switching signal 41 and the interconnection part 14 that transmits a control signal are formed on the connection substrate 91 such as an FPC. This can reduce a resistance compared to the case where the interconnection parts 16 and 14 are formed on a glass substrate, thereby enhancing the reliability of the liquid crystal display.

The preferred embodiments of the present invention can be combined freely, and each of the preferred embodiments can be modified or omitted where appropriate without departing from the scope of the invention.

While the invention has been shown and described in detail, the foregoing description is in all aspects illustrative and not restrictive. It is therefore understood that numerous modifications and variations can be devised without departing from the scope of the invention.

What is claimed is:

1. A display, comprising:

a display panel in which a plurality of image signal lines and a plurality of scanning lines are formed in a matrix;

a plurality of image signal line driving circuits arranged around said display panel, the image signal line driving circuits driving said image signal lines; and a scanning line driving circuit arranged around said display panel, the scanning line driving circuit driving said scanning lines, wherein each of said image signal line driving circuits includes a timing controller that generates a control signal to control the image signal line driving circuit itself and a different image signal line driving circuit, an image signal line driving circuit in a master mode among said plurality of image signal line driving circuits has a function of applying said control signal to an image signal line driving circuit in a slave mode among said plurality of image signal line driving circuits, each of said image signal line driving circuits includes an abnormality detecting circuit and a master/slave switching circuit, the abnormality detecting circuit detecting an operation abnormality in the image signal line driving circuit itself, the master/slave switching circuit setting the image signal line driving circuit itself as said image signal line driving circuit in said master mode or as said image signal line driving circuit in said slave mode, and when detecting an abnormality, said abnormality detecting circuit outputs a master/slave switching signal and applies the master/slave switching signal to said master/slave switching circuit in said image signal line driving circuit in said master mode and said master/slave switching circuit in said image signal line driving circuit in said slave mode, thereby switching said image signal line driving circuit in said slave mode to said master mode and switching said image signal line driving circuit in said master mode to said slave mode.

2. The display according to claim 1, wherein said abnormality detecting circuit is provided in said image signal line driving circuit in said master mode, and said abnormality detecting circuit detects at least an abnormality of a consumption current in said timing controller.

3. The display according to claim 1, wherein said abnormality detecting circuit is provided in said image signal line driving circuit in said master mode, and said abnormality detecting circuit detects the cycle and the voltage level of said control signal.

4. The display according to claim 1, wherein said abnormality detecting circuit is provided in said image signal line driving circuit in said slave mode, and said abnormality detecting circuit detects the cycle and the voltage level of said control signal applied from said image signal line driving circuit in said master mode.

5. A display, comprising:

a display panel in which a plurality of image signal lines and a plurality of scanning lines are formed in a matrix;

a plurality of image signal line driving circuits arranged around said display panel, the image signal line driving circuits driving said image signal lines;

a scanning line driving circuit arranged around said display panel, the scanning line driving circuit driving said scanning lines; and an abnormality detecting circuit arranged externally to said image signal line driving circuits and said scanning line driving circuit, the abnormality detecting circuit detecting an operation abnormality in at least one of said image signal line driving circuits, wherein each of said image signal line driving circuits includes a timing controller that generates a control signal to control the image signal line driving circuit itself and a different image signal line driving circuit, an image signal line driving circuit in a master mode among said plurality of image signal line driving circuits has a function of applying said control signal to an image signal line driving circuit in a slave mode among said plurality of image signal line driving circuits, each of said image signal line driving circuits includes a master/slave switching circuit that sets the image signal line driving circuit itself as said image signal line driving circuit in said master mode or as said image signal line driving circuit in said slave mode, said abnormality detecting circuit is connected to said image signal line driving circuit in said master mode, and when detecting an abnormality, said abnormality detecting circuit outputs a master/slave switching signal and applies the master/slave switching signal to said master/slave switching circuit in said image signal line driving circuit in said master mode and said master/slave switching circuit in said image signal line driving circuit in said slave mode, thereby switching said image signal line driving circuit in said slave mode to said master mode and switching said image signal line driving circuit in said master mode to said slave mode.

6. A display, comprising:

a display panel in which a plurality of image signal lines and a plurality of scanning lines are formed in a matrix;

a plurality of image signal line driving circuits arranged around said display panel, the image signal line driving circuits driving said image signal lines;

a scanning line driving circuit arranged around said display panel, the scanning line driving circuit driving said scanning lines; and a master/slave switching circuit arranged externally to said image signal line driving circuits and said scanning line driving circuit, the master/slave switching circuit setting said image signal line driving circuits as image signal line driving circuits in a master mode or as image signal line driving circuits in a slave mode, wherein each of said image signal line driving circuits includes a timing controller that generates a control signal to control the image signal line driving circuit itself and a different image signal line driving circuit, an image signal line driving circuit in said master mode among said plurality of image signal line driving circuits has a function of applying said control signal to an image signal line driving circuit in said slave mode among said plurality of image signal line driving circuits, each of said image signal line driving circuits includes an abnormality detecting circuit that detects an operation abnormality in the image signal line driving circuit itself, and when detecting an abnormality, said abnormality detecting circuit outputs a master/slave switching signal and applies the master/slave switching signal to said master/slave switching circuit, thereby switching said image signal line driving circuit in said slave mode to said master mode and switching said image signal line driving circuit in said master mode to said slave mode.

7. The display according to claim 1, wherein said control signal includes a cascade signal and a gate control signal to be applied to said scanning line driving circuit, and each of said image signal line driving circuits includes a transfer circuit, when said image signal line driving circuit in said slave mode is switched to said master mode, said transfer circuit receiving said cascade signal and said gate control signal output from said image signal line driving circuit having been switched to said master mode and applying said cascade signal and said gate control signal to said scanning line driving circuit.

8. The display according to claim 5, wherein said control signal includes a cascade signal and a gate control signal to be applied to said scanning line driving circuit, and each of said image signal line driving circuits includes a transfer circuit, when said image signal line driving circuit in said slave mode is switched to said master mode, said transfer circuit receiving said cascade signal and said gate control signal output from said image signal line driving circuit having been switched to said master mode and applying said cascade signal and said gate control signal to said scanning line driving circuit.

9. The display according to claim 6, wherein said control signal includes a cascade signal and a gate control signal to be applied to said scanning line driving circuit, and each of said image signal line driving circuits includes a transfer circuit, when said image signal line driving circuit in said slave mode is switched to said master mode, said transfer circuit receiving said cascade signal and said gate control signal output from said image signal line driving circuit having been switched to said master mode and applying said cascade signal and said gate control signal to said scanning line driving circuit.

* * * * *